US008031163B2

(12) United States Patent
Kim et al.

(10) Patent No.: US 8,031,163 B2
(45) Date of Patent: Oct. 4, 2011

(54) LIQUID CRYSTAL DISPLAY DEVICE AND DRIVING METHOD THEREOF

(75) Inventors: Dong-Woo Kim, Seoul (KR); Jung-Hoon Seo, Annyang-si (KR)

(73) Assignee: LG Display Co., Ltd., Seoul (KR)

( * ) Notice: Subject to any disclaimer, the term of this patent is extended or adjusted under 35 U.S.C. 154(b) by 1498 days.

(21) Appl. No.: 11/476,370

(22) Filed: Jun. 28, 2006

(65) Prior Publication Data

US 2007/0139354 A1 Jun. 21, 2007

(30) Foreign Application Priority Data

Dec. 19, 2005 (KR) ..... 10-2005-0125140

(51) Int. Cl.
*G09G 3/36* (2006.01)

(52) U.S. Cl. ..... 345/102; 345/103

(58) Field of Classification Search ..... 345/87, 345/89, 98, 100, 204, 690, 102, 103
See application file for complete search history.

(56) References Cited

U.S. PATENT DOCUMENTS 6,359,663 B1 * 3/2002 Gadeyne et al. ..... 348/790
6,778,238 B2 * 8/2004 Moon et al. ..... 349/106
7,063,448 B2 * 6/2006 Kang et al. ..... 362/558
7,275,850 B2 * 10/2007 Nesterenko et al. ..... 362/609
7,304,482 B1 * 12/2007 Kay et al. ..... 324/615
7,505,054 B2 * 3/2009 Thompson ..... 345/698
7,532,225 B2 * 5/2009 Fukushima et al. ..... 345/696
7,574,072 B2 * 8/2009 Fujii et al. ..... 382/300
7,719,623 B2 * 5/2010 Hsieh et al. ..... 349/39
7,734,143 B2 * 6/2010 Mizuhashi et al. ..... 386/46
2006/0077214 A1 * 4/2006 Tsou et al. ..... 345/690

* cited by examiner

*Primary Examiner* — Ricardo L Osorio

(74) *Attorney, Agent, or Firm* — Brinks Hofer Gilson & Lione

(57) ABSTRACT

A liquid crystal display (LCD) device includes a data converter for processing first and second data signals, a backlight unit emitting light having a luminance, and a liquid crystal panel supplied with the light. The LCD panel has a first and second region corresponding to the first and second data signals. The data converter differently processes gray levels of the first and second data signals a and the luminance is adjusted when the first and second regions have different brightness. The LCD driving method allows presentation of different image regions on a screen, such as moving image screens and static image screens without brightness degradation.

22 Claims, 7 Drawing Sheets
(2 of 7 Drawing Sheet(s) Filed in Color)

LIQUID CRYSTAL DISPLAY DEVICE AND DRIVING METHOD THEREOF

The present application claims the benefit of Korean Patent Application No. 2005-0125140, filed in Korea on Dec. 19, 2005, which is hereby incorporated by reference in its entirety.

BACKGROUND

1. Technical Field

The technical field generally relates to a liquid crystal display device, and particularly relates to a device and a method of driving a liquid crystal display device for display regions of differing brightness.

2. Discussion of the Related Art

Display devices may use cathode-ray tubes (CRT). Other flat panel displays, such as liquid crystal display (LCD) devices, plasma display panels (PDP), field emission displays, and electro-luminescence displays (ELD), exist as alternatives to the CRT. In particular, LCD devices have been widely used. LCD devices may provide several advantages, such as high resolution, light weight, thin profile, compact size, and low power supply requirements.

An LCD device may include two substrates that are spaced apart and face each other with a liquid crystal material interposed between the two substrates. The two substrates include electrodes that face each other such that a voltage applied between the electrodes induces an electric field across the liquid crystal material. The light transmissivity of the LCD device can be changed by adjusting the intensity of the induced electric field to change an alignment of the liquid crystal molecules in the liquid crystal material. Thus, the LCD device displays images by varying the intensity of the induced electric field.

FIG. 1 is a block diagram of an LCD device according to the related art.

As shown in FIG. 1, the LCD device may include a liquid crystal panel 190, a driving circuit 100 and a backlight unit 192.

The liquid crystal panel 190 includes a plurality of gate lines GL1 to GLn and a plurality of data lines DL1 to DLm (where n and m are natural numbers) crossing each other to define a plurality of pixel regions P. In each pixel region P, a thin film transistor T may be connected to the corresponding gate and data lines, and a liquid crystal capacitor Clc may be connected to the thin film transistor T.

The driving circuit 100 may include an interface 140, a timing controller 130, gate and data drivers 110 and 120 and an inverter 150.

The interface 140 may be supplied with data signals and control signals, such as a horizontal synchronization signal (Hsync), a vertical synchronization signal (Vsync), a data enable signal (DE) and a data clock (DCLK) from an external operating system 50 and may transfer such the signals to the timing controller 130.

The timing controller 130 generates control signals and data signals using the signals transferred from the interface 140.

The gate driver 110 may enable the gate lines GL1 to GLn according to the control signals supplied from the timing controller 130, and may enable the gate lines sequentially. The thin film transistors T connected to the enabled gate line may be turned on. The data driver 120 generates data voltages according to the control signals supplied from the timing controller 130 and outputs the data voltages to the data lines DL1 to DLm. The data voltages are supplied to the liquid crystal capacitors Clc connected to the enabled gate line.

The inverter 150 generates a backlight driving voltage from a DC voltage input thereto and outputs the backlight driving voltage to the backlight unit 192.

Although not shown in FIG. 1, the driving circuit further includes a power supplier supplying voltages to components of the LCD device and a gamma reference voltage generator supplying gamma reference voltages to the data driver 120.

Some computer display windows, for example, a window for displaying a high resolution image such as a moving image and a window for displaying a low resolution image such as a standing image (a word processor) may be displayed simultaneously in a screen of the liquid crystal panel for user's convenience. FIG. 3 example windows displayed simultaneously in the screen of the related art liquid crystal panel.

However, the related art LCD device may not normally display all windows in the screen. In other words, a user may perceive that a moving image is normally displayed when the moving image is bright and a word processor is normally displayed when the standing image is darker than the moving image. In this situation, brightnesses for the different displayed images may be different.

If the backlight unit supplies a light having a luminance suitable to display one of the windows, other windows requiring a different luminance may not be normally displayed. For example, if the backlight unit supplies light of about 300 nit, a user may perceive that the moving image is normally displayed but the standing image is abnormally displayed, such as too brightly. If the backlight unit supplies light of about 100 to 150 nit, a user may perceive that the standing image is normally displayed but the moving image is abnormally displayed, such as too darkly.

SUMMARY

Accordingly, the LCD device and method are directed to a display device and a driving method, which substantially obviate one or more problems due to limitations and disadvantages of the related art.

An LCD device and driving method are disclosed that may normally display various images simultaneously requiring various brightness.

A liquid crystal display device includes a data converter that processes a first data signal and a second data signal. A backlight unit emits a light source having a luminance. A liquid crystal panel is configured to receive the light source and has a first region and a second region corresponding to the first data signal and the second data signals, respectively, where gray levels of the first and second data signals are differently processed and the luminance is adjusted when the first and second regions have different brightness.

A method that drives a liquid crystal display device includes processing first and second data signals. The method displays first and second regions in a liquid crystal panel, where the first and second regions correspond to the first and second data signals, respectively. Light is emitted having a luminance to the liquid crystal panel. Gray levels of the first and second data signals are differently processed and the luminance is adjusted when the first and second regions have different brightness.

A method of driving a liquid crystal display device includes processing first and second data signals. First and second regions are displayed in a liquid crystal panel, where the first and second regions correspond to the first and second data signals, respectively. A light source emits light having a luminance to the liquid crystal panel. The gray levels of the first and second data signals are differently processed and the luminance is adjusted when the first and second regions are normally displayed simultaneously to have first and second brightness, respectively.

It is to be understood that both the foregoing general description and the following detailed description of the disclosure are explanatory and are intended to provide further explanation of the disclosure as claimed.

BRIEF DESCRIPTION OF THE DRAWINGS

The file of this patent contains at least 2 drawings executed in color. Copies of this patent with color drawings will be provided by the Patent and Trademark Office upon request and payment of the necessary fee.

DETAILED DESCRIPTION

Reference will now be made in detail to example systems of the disclosure, which are illustrated in the accompanying drawings.

Figure 1:
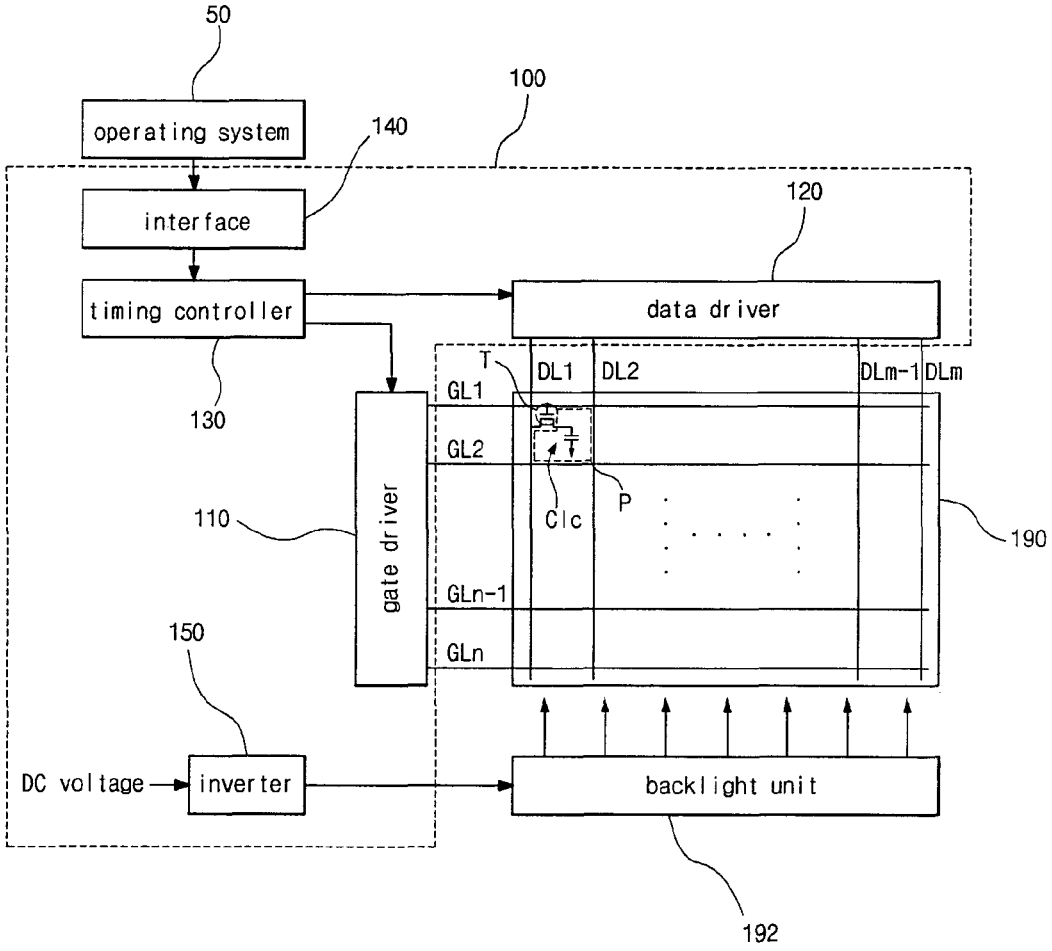
FIG. 1 RELATED ART
FIG. 1 is a block diagram of an LCD device according to the related art.
Figure 2:
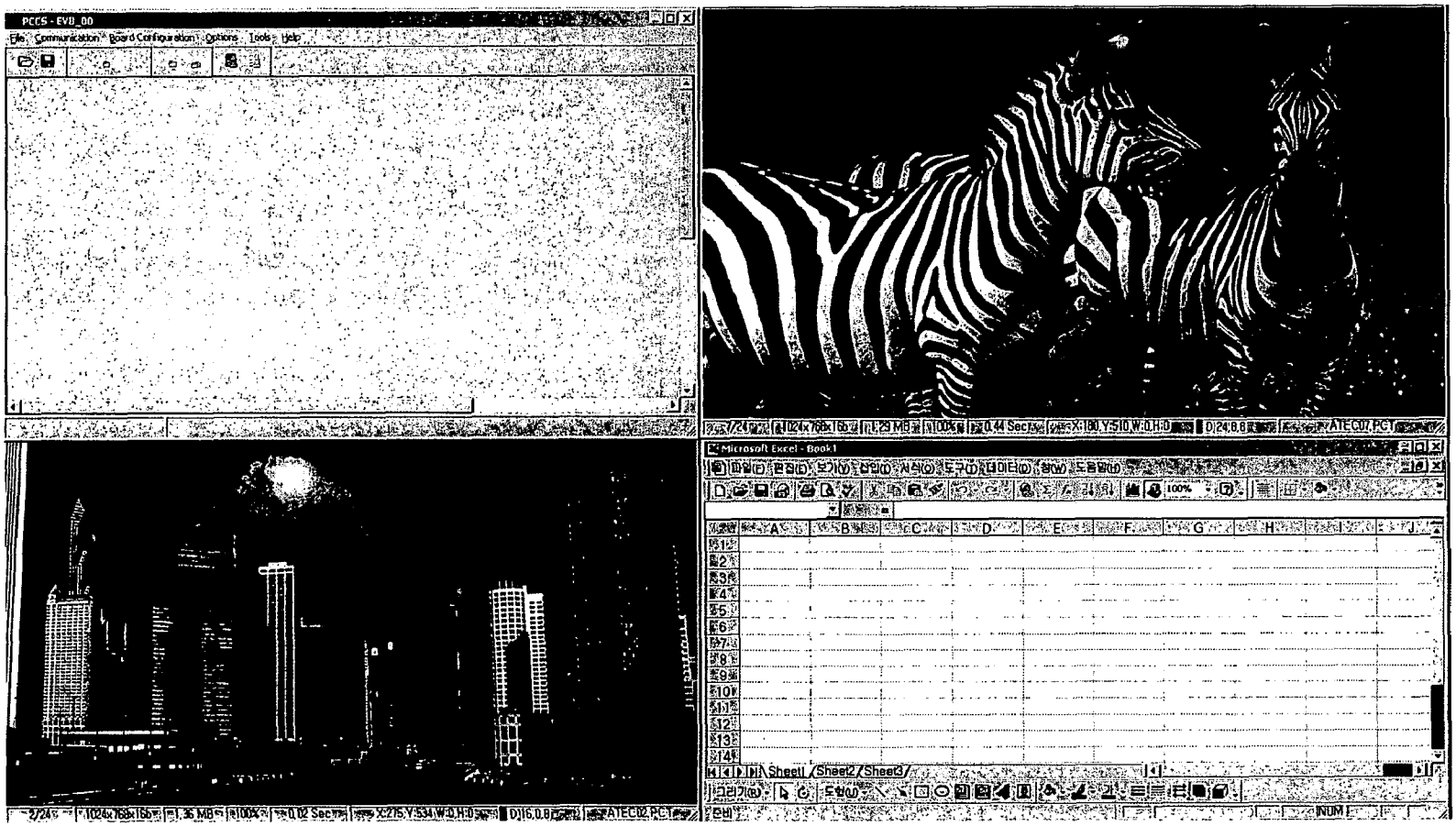
Fig. 2 RELATED ART
FIG. 2 illustrates example windows displayed simultaneously in the screen of the related art liquid crystal panel.
Figure 3:
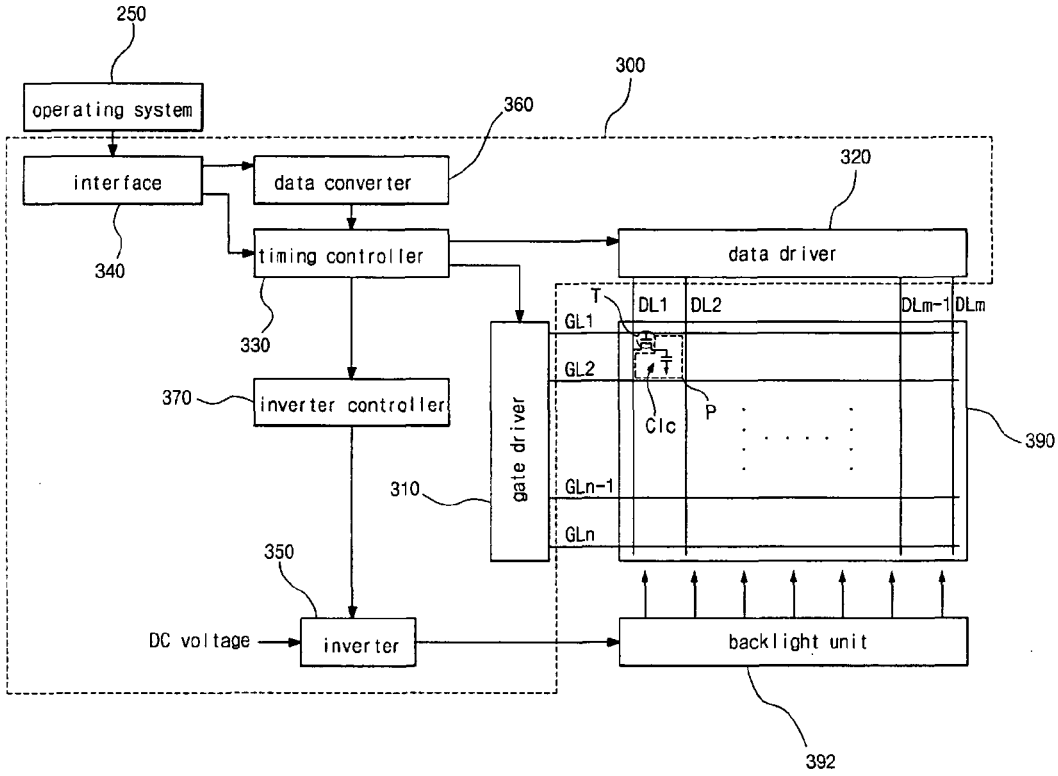
FIG. 3 is a block diagram of an LCD device.

FIG. 3 is a block diagram of an LCD device.

As shown in FIG. 3, the LCD device includes a liquid crystal panel 390, a driving circuit 300 and a backlight unit 392.

The liquid crystal panel 390 includes a plurality of gate lines GL1 to GLn and a plurality of data lines DL1 to DLm (where n and m are natural numbers) crossing each other to define a plurality of pixel regions P. In each pixel region P, a thin film transistor T may be connected to the corresponding gate and data lines, and a liquid crystal capacitor Clc may be connected to the thin film transistor T. The liquid crystal capacitor Clc may include a pixel electrode, a common electrode and a liquid crystal layer between the pixel and common electrodes. A light transmissivity of the liquid crystal layer may be changed by adjusting an intensity of the induced electric field between the two electrodes.

The driving circuit 300 includes an interface 340, a timing controller 330, gate and data drivers 310 and 320, an inverter 350, a data converter 360 and an inverter controller 370.

The interface 340 is supplied with data signals and control signals such as a horizontal synchronization signal (Hsync), a vertical synchronization signal (Vsync), a data enable signal (DE) and a data clock (DCLK) from an external operating system 250, and may transfer such the signals to the timing controller 330 and the data converter 360. The interface 340 is supplied with a selected region position signal and a luminous signal.

Figure 4:
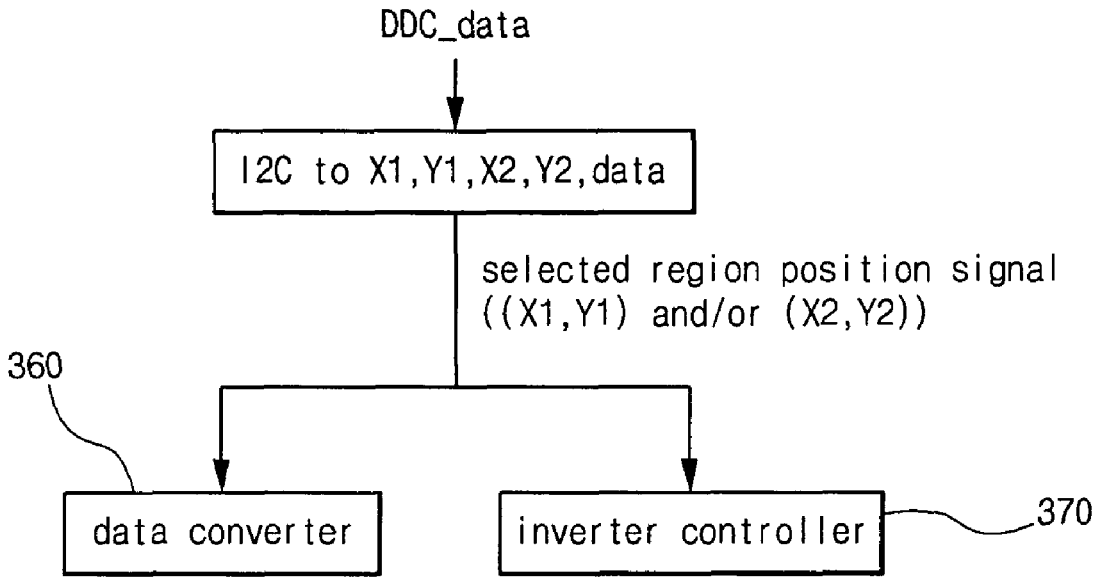
FIG. 4 is a block diagram showing a generation and an input of a selected region position signal in an LCD device.

FIG. 4 is a block diagram showing a generation and an input of a selected region position signal in an LCD device.

In FIG. 4, DDC data 402 is provided to an I2C bus module 410. $I^2C$ uses only two bidirectional open-collector lines, serial data line (SDA) and serial clock line (SCL), pulled up with resistors. The maximum voltage is +5 V, although +3.3 V systems are common and other voltages are permitted.

The I2C bus module has a 7-bit address space with 16 reserved addresses, so a maximum of 112 nodes can communicate on the same bus. The most common I2C bus modes are the 100 kbits standard mode and the 10 kbits low-speed mode, but clock frequencies down to zero are also allowed.

The I2C bus module 410 provides (X1,Y1) and/or (X2,Y2) position data indicating the position of the selected regions of the display. The I2C bus module 410 outputs a selected region position signal 415 comprising the X1, Y1, X2, and Y2 position data. The selected region position signal 415 is output to the data converter 360 and the inverter controller 370. For example, a user may input or select a region of the screen designated by coordinates such as X1, Y1, X2, and Y2. This region may indicate a region selected for increased brightness relative to other regions of the screen. The I2C bus module 410, in this example, converts the X1, Y1, X2, and Y2 data to a format processed by the I2C serial data bus interfaced with the display, and the I2C bus module 410 transmits the selected region position signal 415 to the data converter 360 and the inverter controller 370.

In FIG. 3, the data converter 360 is supplied with the data signals from the interface 340 and processes the data signals according to the selected region position signal. The data converter 360 converts gray levels of the data signals based on the selected region position signal. Data signals by one frame displaying a screen may be supplied to the data converter 360. The screen may include a first region, such as a moving image region, displaying a high brightness and a second region, such as a standing image region, displaying a low brightness. If the selected region position signal is an information signal designating a position of the first region, the selected region position signal determines the first data signals for the first region and the second data signals for the second region, out of the data signals by one frame inputted to the data converter 360. The selected region position signal may be generated automatically by a selection program in the operating system 250 or may be generated manually by a user.

Figure 5:
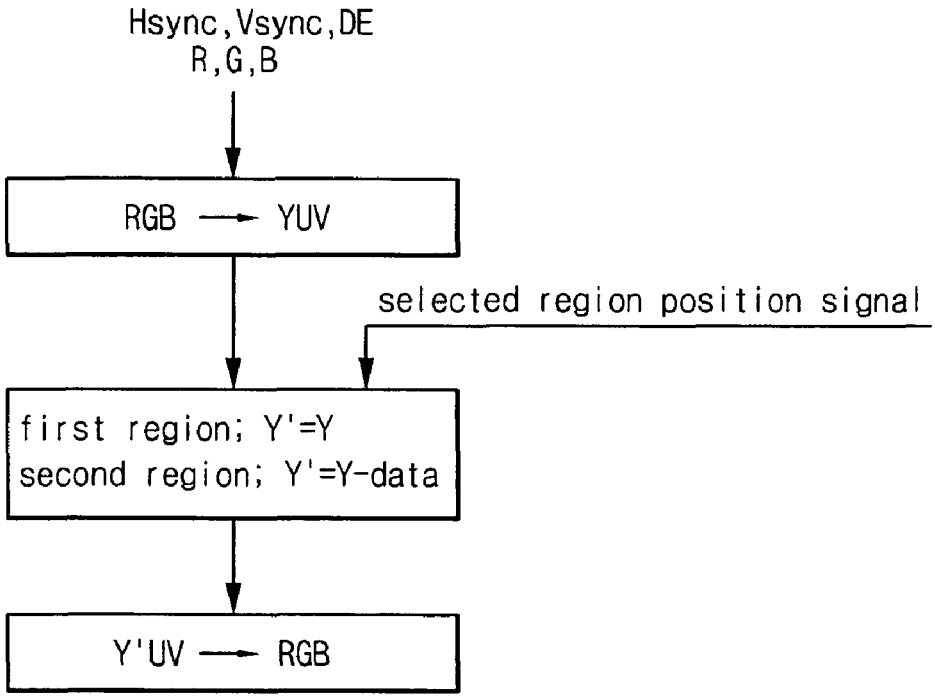
FIG. 5 is a block diagram showing a data conversion in a data converter of an LCD device.

FIG. 5 is a block diagram showing a data conversion in a data converter of an LCD device n.

In FIG. 5, DDC data 505, such as Hsync, Vsync, DE, R, G, and B data is provided to an RGB-YUV converter module 510. The RGB-YUV converter module 510 processes the DDC data 505 based on Eqns 1-3 below:

$$Y=0.299R+0.587G+0.114B \quad \text{Eqn. 1}$$

$$U=-0.147R-0.289G+0.436B \quad \text{Eqn. 2}$$

$$V=0.615R-0.515G-0.100B \quad \text{Eqn. 3}$$

The Region Selection Module 520 receives the output from the RGB-YUV converter module 510 and the selected region position signal 515. The selected region position signal 515 indicates information related to the positions of selected regions on the display for which different processing is indicted. The Region Selection Module 520 processes the YUV input data and the selected region position signal 515 to generate selected regions which are modified in brightness. Based on a first set of coordinates from the selected region position signal 515, a region of the display is selected to have a brightness value Y' based on the Y value determined with Eqn. 1. A second, unselected region is determined to have a brightness value Y" based on the Y value determined with Eqn. 1 and a brightness adjustment data, such as Y"=Y-data.

The adjusted brightness values Y' and Y" are output to a YUV-RGB converter module 530. The YUV-RGB converter module 530 is operable to convert the processed YUV values to RGB values that are used by the display to output the selected regions of the display. The YUV-RGB converter module 530 implements a series of inversions of the YUV data using Eqns. 4-6 below:

$$B=1.164(Y-16)+2.018(U-128) \quad \text{Eqn. 4}$$

$$G=1.164(Y-16)-0.813(V-128)-0.391(U-128) \quad \text{Eqn. 5}$$

$$R=1.164(Y-16)+1.596(V-128) \quad \text{Eqn. 6}$$

In FIG. 3, the data converter 360 may convert one of the gray levels of the first data signals and the gray levels of the second data signals, or may convert both signals differently from each other. For example, the gray levels of the first data signals may be upgraded and the gray levels of the second data signals may be maintained at the same level without conversion. The gray levels of the first data signals may be maintained at the same level, and the gray levels of the second data signals may be downgraded. The gray levels of the first data signals may be upgraded and the gray levels of the second data signals may be downgraded. According to this conversion of the gray levels, the first region displays a brightness higher than before the gray level processing.

The timing controller 330 generates control signals and data signals using the control signals transferred from the interface 340. The data signals processed for gray levels in the data converter 360 may be transmitted to the data driver 320. The timing controller 330 transfers the luminous signal to the inverter controller 370.

The gate driver 310 may enable the gate lines GL1 to GLn according to the control signals supplied from the timing controller 330. The gate driver 310 may enable the gate lines sequentially. The thin film transistors T connected to the enabled gate line are turned on. The data driver 320 generates data voltages from the data signals processed by the timing controller 330 based on the control signals supplied from the timing controller 330. The data driver 320 outputs the data voltages to the data lines DL1 to DLm. The data voltages may be supplied to the liquid crystal capacitors Clc connected to the enabled gate line.

The inverter controller 370 generates an inverter control signal from the luminous signal. The luminous signal is an information signal designating a luminance of light emitted from the backlight unit 392. The luminous signal determines the luminance of light from the inverter controller 370. The luminous signal may be generated automatically by the selection program in the operating system 250 or generated manually by the user, similarly to the selected region position signal.

The inverter 350 is supplied with the inverter control signal based on the luminous signal and outputs a backlight driving voltage to control the backlight unit 392. The backlight unit 392 emits a light source having a luminance adjusted according to the luminous signal. For example, the luminance of the backlight unit 392 is within a range of about 170 nit (cd/m$^2$) to about 400 nit (cd/m$^2$).

The luminance of light emitted from the backlight unit 392 relates to conversion of the gray levels of the data signals in the data converter 360, to display both the first region and the second region.

By converting the gray levels of the data signals, the first region may displays brightness of higher value than the brightness value of the second region. With the conversion of the gray levels without the luminance adjustment, the first region and the second region may not be normally displayed, because the transmissivity of the liquid crystal panel to each gray level is constant. If the screen is supplied with a first luminance from the backlight unit, which is sufficient to display normally the first region but insufficient to normally display the second region, the first and second regions are not normally displayed simultaneously. The backlight unit supplies light of a second luminance higher than the first luminance, and at the same time, the conversion of the gray levels of the data signals may occur. For example, the gray levels of the first data signals corresponding to the first region are upgraded and the gray levels of the second data signals corresponding to the second region are downgraded. The first region displays a high brightness value required and the second region displays a low brightness value required. A user perceives that the first and second regions are normally displayed simultaneously. Through the gray level conversion and the luminance adjustment, the different images having different brightness values are normally displayed simultaneously. The second luminance may be a value between the first luminance value and a third luminance value for normally displaying the second region.

Alternately, the backlight unit may supply light having one of the first luminance and the third luminance based on the luminous signal. When the first region displays brightness of higher value than the brightness value of the second region, the user may concentrates on one of the first region and the second region. The luminous signal may have information about the concentration, and the light emitted from the backlight unit 392 may have one of the first luminance for the first region and the third luminance for the second region based on the luminance signal having the concentration information. For example, when the screen has the first region and the second region displaying different brightness by converting the gray levels of the data signals, the user may concentrate on the first region. The luminous signal may have information about the concentration on the first region, and the backlight unit emits the light having the first luminance for the first region. In addition, when the user concentrates on the second region, the luminous signal may have information about the concentration on the second region. As a result, the backlight unit 392 may emit the light having the third luminance for the second luminance.

Figure 6:
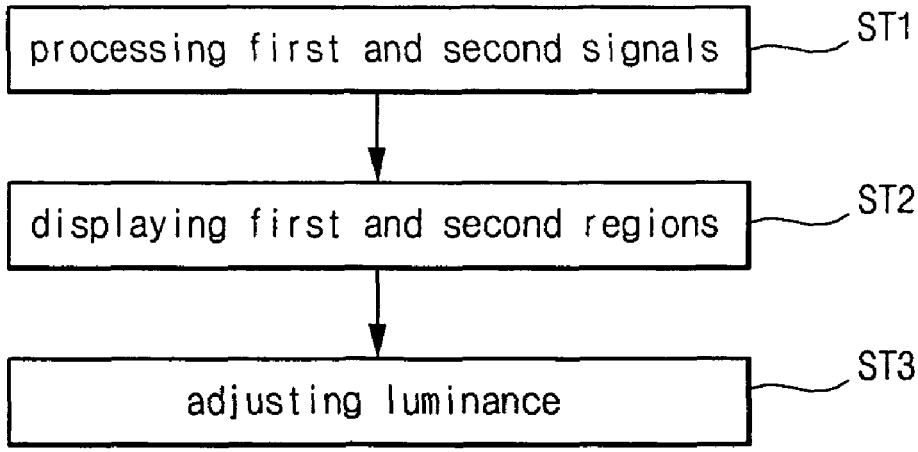
FIG. 6 is a block diagram showing an operation of an LCD device.

FIG. 6 is a block diagram showing an operation of an LCD device according to the exemplary embodiment of the present invention.

At step ST1, the data signal is divided into the first and second data signals designating the first and second regions, respectively, of the liquid crystal panel 390 on the basis of the selected region position signal, and the first and second data signals are processed in the data converter 360. As a result, the gray levels the first data signal for the first region and the second data signal for the second region are differently converted.

At step ST2, the first region of the liquid crystal panel 390 is displayed with the first brightness and the second region of the liquid crystal panel 390 is displayed with the second brightness different from the first brightness.

At step ST3, the luminance of the light emitted from the backlight unit 392 to the liquid crystal panel 390 is adjusted according to the luminous signal. The luminance of the light may be adjusted so that the different images having different brightness values can be normally displayed in the first and second regions simultaneously. Alternately, the luminance of the light may be adjusted so that one image having a predetermined brightness can be normally displayed in one of the first and the second regions and the other image can not be normally displayed in the other one of the first and second regions.

Figure 7:
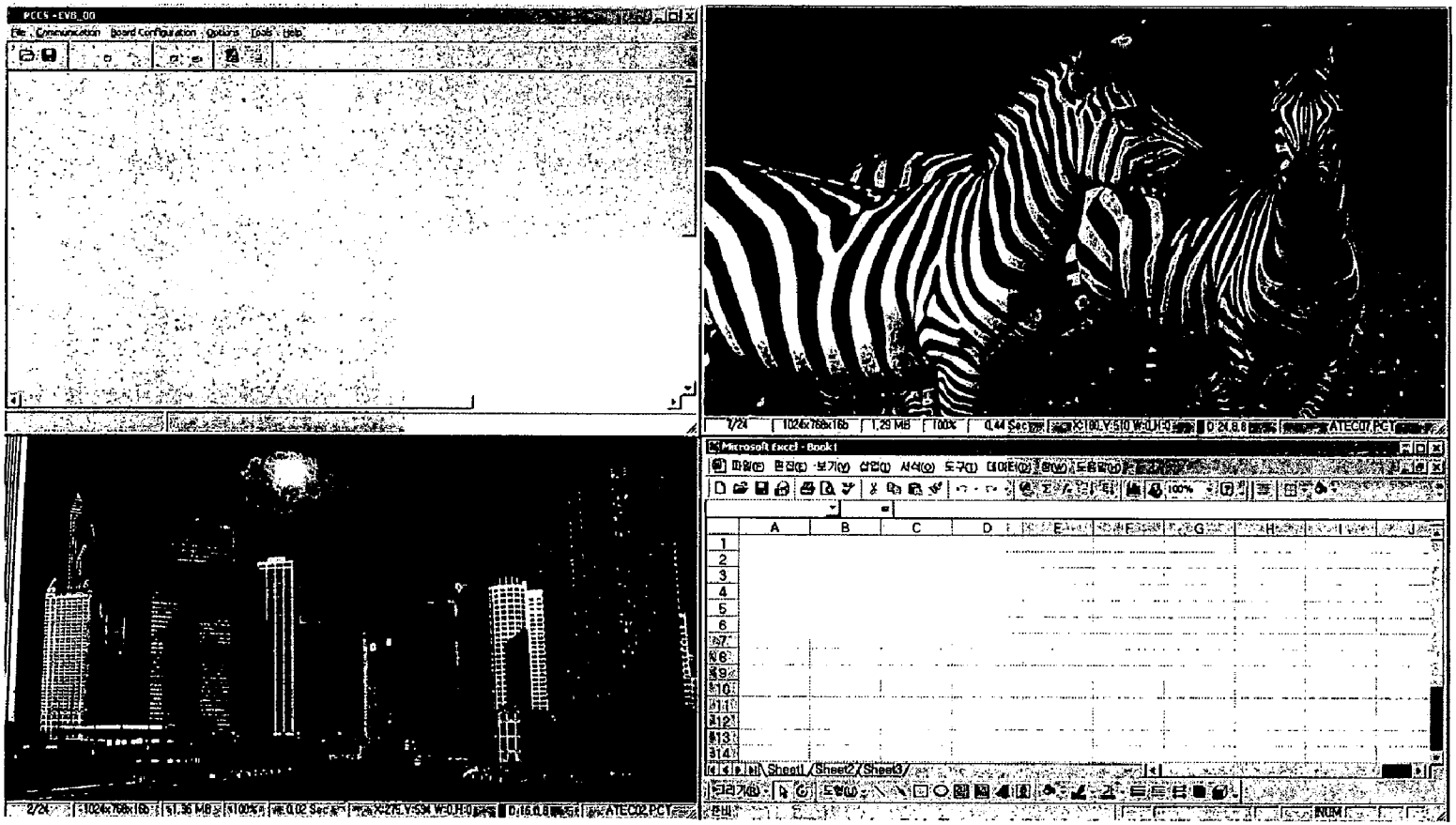
FIG. 7 illustrates example windows displayed simultaneously in the screen of the liquid crystal panel.

FIG. 7 illustrates example windows displayed simultaneously in the screen of the liquid crystal panel. In FIG. 7, as the selected region position signal designates a center region, a center region of the screen is bright and other region is darker than the center region.

Before the center region is selected according to the selected region position signal, the entire screen displays the same brightness. When the center region is selected, the center region is brighter than the other region so that two regions can display different brightness. A luminance from the backlight unit may increase, and the gray levels of the data signals for the center region may be upgraded and the gray levels of the data signals for the other region may be downgraded.

Four windows, two moving images and two standing images (a word processor and a spreadsheet program, for example), are disposed in both the center region and the other region. The moving images are normally displayed in the center region but abnormally displayed more brightly in the other region. The standing images are abnormally displayed more darkly in the center region but normally displayed in the other region.

If the selected region position signal designates the moving images, the gray level processing and the luminance adjustment are performed, and the moving images and the standing images can be normally displayed simultaneously.

When the screen displays different brightness after the screen entirely displays the same brightness, the gray level processing and the luminance adjustment are performed. Therefore, different images having different brightness values may be normally displayed.

It will be apparent to those skilled in the art that various modifications and variations can be made in the liquid crystal display device and the method of driving the liquid crystal display device without departing from the spirit or scope of the disclosure. Thus, it is intended that the disclosure cover the modifications and variations provided they come within the scope of the appended claims and their equivalents.

What is claimed is:

1. A liquid crystal display device, comprising:

a data converter configurable to process a first data signal and a second data signal;

a backlight unit configurable to emit a light having a luminance; and a liquid crystal panel supplied with the light and comprising a first region and a second region corresponding to the first and second data signals, respectively, wherein gray levels of the first and second data signals are differently processed and the luminance is adjusted when the first and second regions have a different brightness.

2. The device of claim 1, further comprising a timing controller, where the timing controller is operable to receive the processed first and second signals and a luminous signal that adjusts the luminance.

3. The device of claim 2, further comprising an inverter operable to supply a backlight unit driving voltage to the backlight unit, and an inverter controller operable to control the inverter based on the luminous signal.

4. The device of claim 1, wherein the data converter is operable to receive a position signal designating a position of the first region.

5. The device of claim 4, wherein the position signal is generated automatically when the first and second regions have different brightness.

6. The device of claim 4, wherein the position signal is generated manually when the first and second regions have different brightness.

7. The device of claim 1, further comprising an interface operable to receive the first and second data signals from an external operating system.

8. The device of claim 1, wherein the adjusted luminance comprises a value between a luminance value for normally displaying the first region and a luminance value for normally displaying the second region.

9. The device of claim 1, wherein the adjusted luminance comprises at least one of a luminance value for normally displaying the first region and a luminance value for normally displaying the second region.

10. A method of driving a liquid crystal display device, comprising:

processing a first data signal and a second data signal;

displaying a first region and a second region in a liquid crystal panel, the first and second regions corresponding to the first and second data signals, respectively; and emitting a light having a luminance to the liquid crystal panel, processing gray levels of the first and second data signals differently when the first and second regions have different brightness and;

adjusting the luminance when the first and second regions have different brightness.

11. The method of claim 10, further comprising upgrading the gray level of the first signal and downgrading the gray level of the second signal.

12. The method of claim 10, further comprising maintaining the gray level of the first signal and downgrading the gray level of the second signal.

13. The method of claim 10, further comprising upgrading the gray level of the first signal and maintaining the gray level of the second signal.

14. The method of claim 10, further comprising processing the first and second data signals according to a position signal designating the first region when the first and second regions comprise regions of different brightness.

15. The method of claim 14, comprising generating the position signal automatically.

16. The method of claim 14, comprising generating the position signal manually.

17. The method of claim 10, wherein the adjusted luminance comprises a value between a luminance value for normally displaying the first region and a luminance value for normally displaying the second region.

18. The method of claim 10, wherein the adjusted luminance comprises at least one of a luminance value for normally displaying the first region and a luminance value for normally displaying the second region.

19. A method of driving a liquid crystal display device, comprising:

processing a first data signal and a second data signal;

displaying a first region and a second region in a liquid crystal panel, the first and second regions corresponding to the first and second data signals, respectively;

adjusting a luminance of a light of a backlight unit when the first and second regions have different brightness, where the luminance is based on gray levels of the first and second data signals; and emitting the light from the backlight unit to the liquid crystal panel based on the luminance.

20. The method of claim 19, where adjusting a luminance comprises determining a value between a luminance value for normally displaying the first region and a luminance value for normally displaying the second region.

21. The method of claim 19, where adjusting a luminance comprises determining one of a luminance value for normally displaying the first region and a luminance value for normally displaying the second region.

22. A liquid crystal display apparatus, comprising:

data converter means for processing a first data signal and a second data signal;

a backlight means for emitting a light having a luminance; and a liquid crystal panel supplied with the light and comprising a first region and a second region corresponding to the first and second data signals, respectively, wherein the data converter means is configurable to differently process gray levels of the first and second data signals and the luminance is adjusted when the first and second regions have a different brightness.

* * * * *